US006193593B1

(12) United States Patent
Miller et al.

(10) Patent No.: US 6,193,593 B1
(45) Date of Patent: Feb. 27, 2001

(54) GRINDING WHEEL FOR GRINDING MATERIAL FROM BIMETALLIC SURFACES

(76) Inventors: Bradley J. Miller, 55 Fisher St., Westboro, MA (US) 01581; Richard F. Buckley, 8 Comstock Dr., Shrewsbury, MA (US) 01545; David M. Duarte, 5 Fox Run Rd., Sterling, MA (US) 01564; John Hagan, 2 Bannister St., Shrewsbury, MA (US) 01545; Mianxue Wu, 29 Collins St., Worcester, MA (US) 01606

( * ) Notice: Subject to any disclaimer, the term of this patent is extended or adjusted under 35 U.S.C. 154(b) by 0 days.

(21) Appl. No.: 09/351,965

(22) Filed: Jul. 12, 1999

Related U.S. Application Data

(62) Division of application No. 08/908,657, filed on Aug. 7, 1997, now Pat. No. 5,951,378.

(51) Int. Cl.[7] ..... B24B 25/00

(52) U.S. Cl. ..... 451/461; 451/527; 451/547

(58) Field of Search ..... 451/78, 57, 65, 451/58, 259, 461, 527, 529, 547, 548, 550

(56) References Cited

U.S. PATENT DOCUMENTS

| | | | | |
|---|---|---|---|---|
| 4,018,576 | * | 4/1977 | Lowder et al. . | |
| 4,896,638 | | 1/1990 | Shepley . | |
| 4,934,351 | | 6/1990 | Shepley . | |
| 4,993,891 | | 2/1991 | Kaminiski et al. . | |
| 5,009,676 | * | 4/1991 | Rue et al. . | |
| 5,035,723 | | 7/1991 | Kalinowski et al. . | |
| 5,129,919 | * | 7/1992 | Kalinowski et al. . | |
| 5,203,886 | * | 4/1993 | Sheldon et al. . | |
| 5,221,294 | * | 6/1993 | Carman et al. . | |
| 5,244,477 | * | 9/1993 | Rue et al. . | |
| 5,486,131 | * | 1/1996 | Cesna et al. | 451/56 |
| 5,842,912 | * | 12/1998 | Holzapfel et al. | 451/72 |
| 5,938,506 | * | 8/1999 | Fruitman et al. | 451/41 |

OTHER PUBLICATIONS

E. Lenz, "Negative Rake Cutting To Stimulate Chip Formation in Grinding", S. Malkin, Technion–Israel Institute of Technology, *Annals of the CIRP,* vol. 28 Jan. 1979, pp. 209–212.

R.B. Aronson, "CBN Grinding a Temping Technology", *Manufacturing Engineering,* pp. 35–40, Feb. 1994.

* cited by examiner

*Primary Examiner*—Timothy V. Eley
(74) *Attorney, Agent, or Firm*—Sampson & Associates, P.C.

(57) ABSTRACT

A grinding wheel is provided for grinding the fire deck of an engine block. The grinding wheel, includes a first annular grinding element disposed concentrically with the wheel on a backing plate. The first annular grinding element includes a first abrasive component of either metal brazed single layer abrasive components or abrasive components comprising grain bonded in a porous matrix having about 55 to 80 volume percent interconnected porosity. The wheel preferably has a second annular grinding element disposed concentrically inward of the first annular grinding element. The first annular grinding element preferably comprises a single layer of relatively course diamond abrasive component brazed on a metallic substrate, while the second annular grinding element preferably comprises a single layer of relatively fine diamond abrasive components brazed on a similar substrate. Each of the first and second grinding elements are formed as a discrete units individually fastened to the backing plate to facilitate independent height adjustment of the annular grinding elements relative the backing plate. Fabrication of the first and second annular grinding elements as discrete members individually fastened to the backing plate serves to simplify both assembly of the wheel and height adjustment of the first and second annular grinding elements relative one another. Although one piece annular grinding elements are contemplated, each element may be fabricated as multi-part assemblies, such as two 180 degree or four 90 degree portions in order to prevent the accumulation of stresses and distortion during high speed testing.

20 Claims, 3 Drawing Sheets

GRINDING WHEEL FOR GRINDING MATERIAL FROM BIMETALLIC SURFACES

RELATED APPLICATION

This application is a divisional of U.S. patent application Ser. No. 08/908,657 filed Aug. 7, 1997 now U.S. Pat. No. 5,951,378.

BACKGROUND OF THE INVENTION

1. Field of the Invention

This invention relates to abrasive tools, and more particularly to grinding wheels and methods adapted to remove material from the surface of bimetallic engine blocks.

2. Background Information

As automakers push to reduce the weight of automobiles, the engine block remains one of the heaviest single components. Manufacturing the engine blocks in a bimetallic manner, such as by fabricating the blocks from aluminum and placing cast iron sleeves into the cylinder bores can substantially reduce the weight of the engine block relative to conventional cast iron engine blocks. An important aspect of the engine block manufacturing process, however, is to provide the block with a flat or planarized upper surface or fire deck for mating with the cylinder head. Machining of conventional unimetallic engine blocks (i.e. cast iron) is generally accomplished by common machining processes such as fly cutting or high speed milling utilizing hardened ceramic inserts, such as silicon nitride, tungsten carbide or polycrystalline diamond (PCD), on the milling head. This process using PCD inserts has also now been adopted for use in machining bimetallic blocks. Although satisfactory when utilized for unimetallic blocks, this approach tends to produce undesirable results when used with blocks fabricated from two materials, one of which is soft, i.e., aluminum, and the other of which is brittle, i.e., cast iron. When utilized to mill bimetallic parts, the relatively expensive PCD inserts tend to wear rapidly. Moreover, to insure a smooth and flat surface, multiple passes with the milling inserts are typically utilized, although score lines may still be seen. Waviness also sometimes occurs in the surface of the fire deck. These problems may be associated with, or exacerbated by, the differences in optimal milling tool configuration for soft versus brittle materials. For example, most high-speed milling cutters made for softer materials, such as aluminum, operate most efficiently at substantially greater rake angles than those used for harder materials such as cast iron. Clearance angles, or the angle between the land and a tangent to the cutter from the tip of the tooth, also depend on the various work materials. Cast iron typically requires values of 4 to 7 degrees, whereas soft materials such as magnesium, aluminum, and brass are cut efficiently with clearance angles of 10 to 12 degrees. (See, e.g., B. H. Amstead et al. *Manufacturing Processes,* 1977, pp. 555–556).

One solution to this problem has been to countersink the cast iron sleeves to the depth to which the aluminum is to be removed. Once countersunk, the aluminum block may then be milled in a conventional manner to bring the aluminum to the predetermined height and flatness. While this approach has been used successfully to planarize fire decks of bimetallic engine blocks, the step of countersinking the cast iron sleeves disadvantageously adds an extra machining step, an extra tool change and an extra tool set up which tends to increase the time and expense of engine block fabrication. It is thus desirable to devise a tool and/or process able to planarize the fire deck of a bimetallic engine block in a single pass or process step.

Another technique commonly utilized for metal removal involves use of conventional grinding wheels, typically face grinding wheel or surface grinding wheel comprising alumina grain in resin bond. While this technique tends to be effective on cast iron workpieces, aluminum is relatively soft, gummy and abrasive, and thus difficult to grind.

Thus, a need exists for an improved tool and/or method for machining fire decks of bimetallic engine blocks in a single process step.

A significant reason for the difficulty associated with milling bimetallic work pieces is that during the milling operation, each blade or insert of the milling head is maintained in relatively interrupted contact with the bimetallic block, in which the insert repeatedly takes relatively large cuts across the boundary between the soft aluminum and the brittle cast iron as the milling head rotates. The relatively large number of cutting points provided by each abrasive grain of a grinding wheel provides a more continuous contact with the workpiece and take smaller cuts or bites as they cross the boundary between materials.

SUMMARY OF THE INVENTION

According to a first aspect of the present invention a grinding cup wheel adapted for grinding material from a fire deck of an engine block has an axis of rotation and a first annular grinding element removably disposed in concentric orientation with the wheel. The first annular grinding element includes a first abrasive component chosen from the group consisting of metal brazed single layer abrasive components and abrasive components comprising grain bonded in a porous matrix having about 55 to 80 volume percent interconnected porosity.

According to a second aspect of the present invention, a grinding cup wheel adapted for grinding a fire deck of a bimetallic engine block has a first annular grinding element disposed concentrically therewith. The grinding cup wheel also has a second annular grinding element disposed concentrically with and radially inward of the first annular grinding element. The second annular grinding element is disposed at a predetermined height in the axial direction closer to the bimetallic surface than the first annular grinding element. The second annular grinding element removes material from the bimetallic surface after the first annular grinding element.

According to a further aspect of the present invention, the grinding wheel is adapted for surface grinding a bimetallic workpiece and includes a first annular grinding element disposed concentrically with an axis of rotation of the wheel. A second annular grinding element is disposed concentrically with and radially inward of the first annular grinding element, each of the first and second annular grinding elements having grinding surfaces adapted to engage the workpiece, the grinding surface of the second annular grinding element being disposed at a predetermined height in the axial direction closer to the engine block than that of the first annular grinding element. The first annular grinding element and the second annular grinding element each include an abrasive component chosen from the group consisting of metal brazed single layer abrasive components and abrasive components bonded in porous matrix having about 55 to 80 volume percent interconnected porosity. The grinding cup wheel is adapted for orientation of the axis of rotation at a predetermined angle alpha relative the fire deck and for being translated towards the engine block along a tool path parallel to the fire deck. The first annular grinding element is adapted to engage and abrasively grind material from the block and said second annular grinding element is adapted to remove material from the fire deck after said first annular grinding ring, so that the second annular grinding ring is adapted to apply a surface finish to the fire deck.

The grinding apparatus also may be adapted for use in finishing other similar bimetallic components of vehicles, machines and the like.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
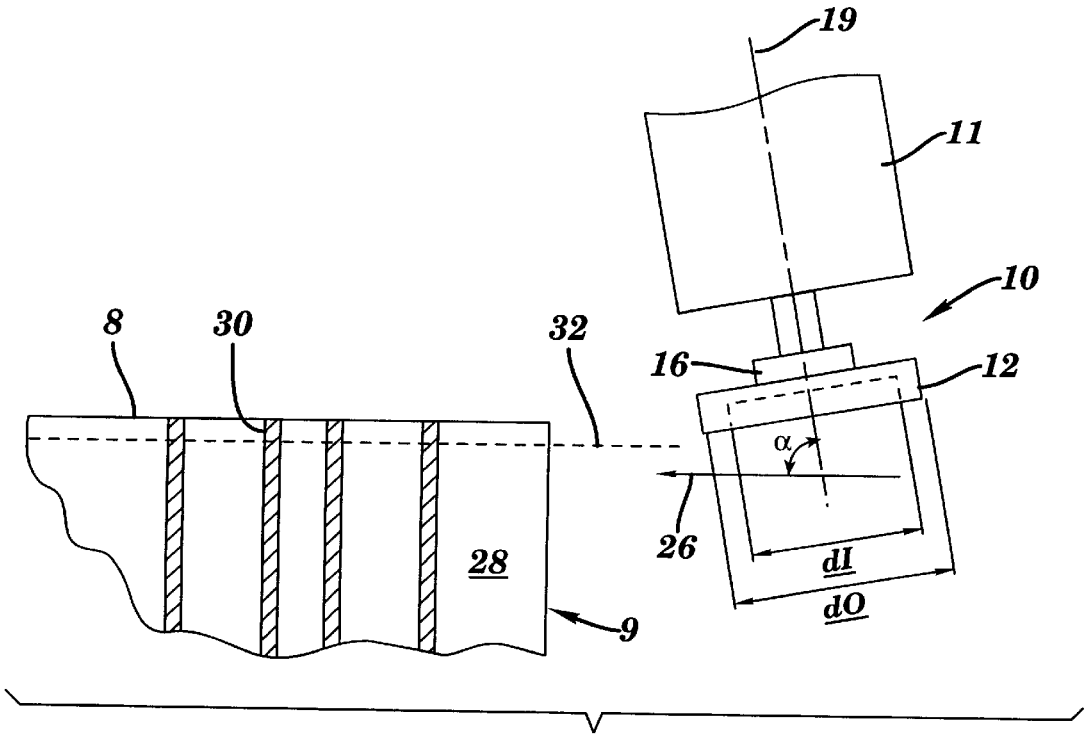
FIG. 1 is an elevational schematic view of a grinding wheel during a step in the process of machining a fire deck of an engine block according to the present invention.

Briefly described, the subject invention includes a method for machining flat or planarizing a fire deck 8 of an engine block 9 (FIG. 1). The method includes providing a grinding wheel 10 (FIG. 1) having an outer annular grinding element or ring 12 (FIG. 3) disposed concentrically with the wheel on a backing plate 16 (FIG. 1). In an alternate embodiment, an inner annular grinding element 14 (FIG. 5) may be disposed concentrically inward of outer element 12. In a preferred embodiment, outer element 12 and inner element 14 each respectively comprise a single layer of diamond abrasive 18 and 22 brazed onto an annular metallic substrate 20 and 24. The inner element 14 may comprise a vitrified bond matrix containing conventional abrasive grain or superabrasive grain (diamond or cubic boron nitride (CBN)). Each grinding element is individually fastenable to the backing plate to facilitate independent height adjustment of the elements relative one another.

The method further comprises orienting grinding wheel 10 (FIG. 1) with its axis of rotation 19 at a predetermined oblique angle a relative fire deck 8. The wheel is then translated towards engine block 9 along a tool path 26 parallel to the fire deck wherein ring 12 will engage the block for bulk material removal, followed by inner ring 14 (if utilized) which removes a smaller amount of material to apply the requisite surface finish to fire deck 8. Fabrication of elements 12 and 14 as discrete members individually fastened to backing plate 16 serves to simplify both assembly of the wheel and height adjustment of elements 12 and 14 relative one another. Although one piece rings are contemplated, each ring 12 and 14 is preferably fabricated as a multi-part assembly, such as in halves (two semicircular, 180 degree portions), or quarters (four 90 degree portions) in order to prevent the accumulation of stresses and distortion during high rotational speed testing.

Throughout this disclosure, the term "axial" when used in connection with a portion of a grinding wheel, shall refer to a direction substantially parallel to axis of rotation 19 as shown in FIG. 1.

Figure 2:
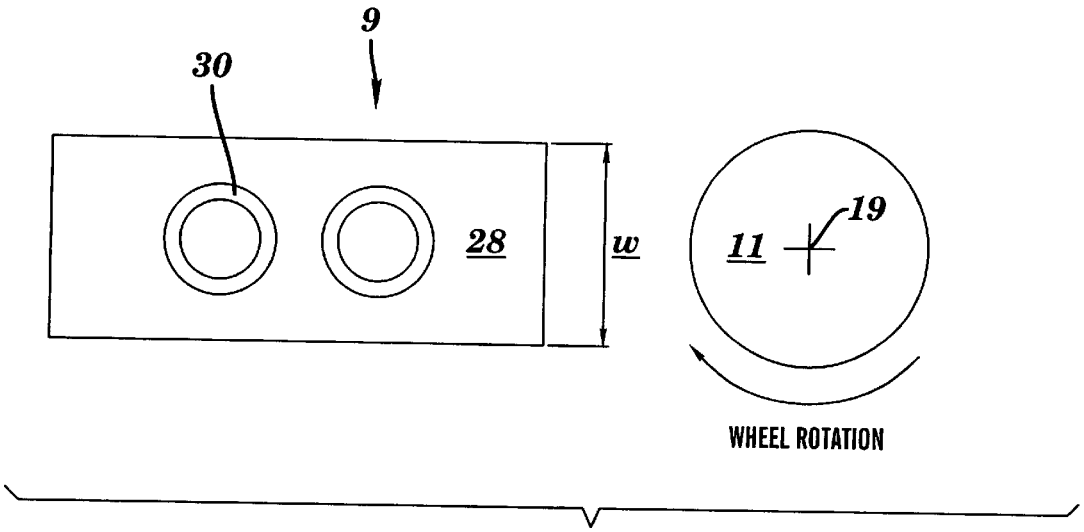
FIG. 2 is a plan view of the process step of FIG. 1.

Referring now to the Figures in detail, as shown in FIGS. 1 and 2, the subject invention includes a method for machining fire deck 8 of an engine block 9. The method includes utilizing grinding wheel 10 in combination with a conventional grinding or milling machine 11 to machine the fire deck. Wheel 10 is fabricated with an industry standard Type 6, or flat cup shape, with outer annular grinding element 12 disposed concentrically on backing plate 16 to comprise the lip of the cup. As shown, grinding wheel 10 is utilized in a conventional face grinding manner, in which its axis of rotation 19 is oriented at a predetermined oblique angle a relative fire deck 8. While maintaining angle $\alpha$ constant, the wheel is translated or moved along tool path 26 to engage and machine block 9, including aluminum block portion 28 and cast iron sleeves 30, to a predetermined height 32. In a preferred embodiment, angle $\alpha$ is approximately 88 or 89 degrees as shown. Alternatively, wheel 10 may be used in any number of operating modes, such as conventional multiple pass, orbital path, etc. Also, angle $\alpha$ may be 90 degrees (not shown) to orient element 12 parallel to fire deck 8, in which diametrically opposed portions of element 12 may contact the fire deck simultaneously.

Figure 3:
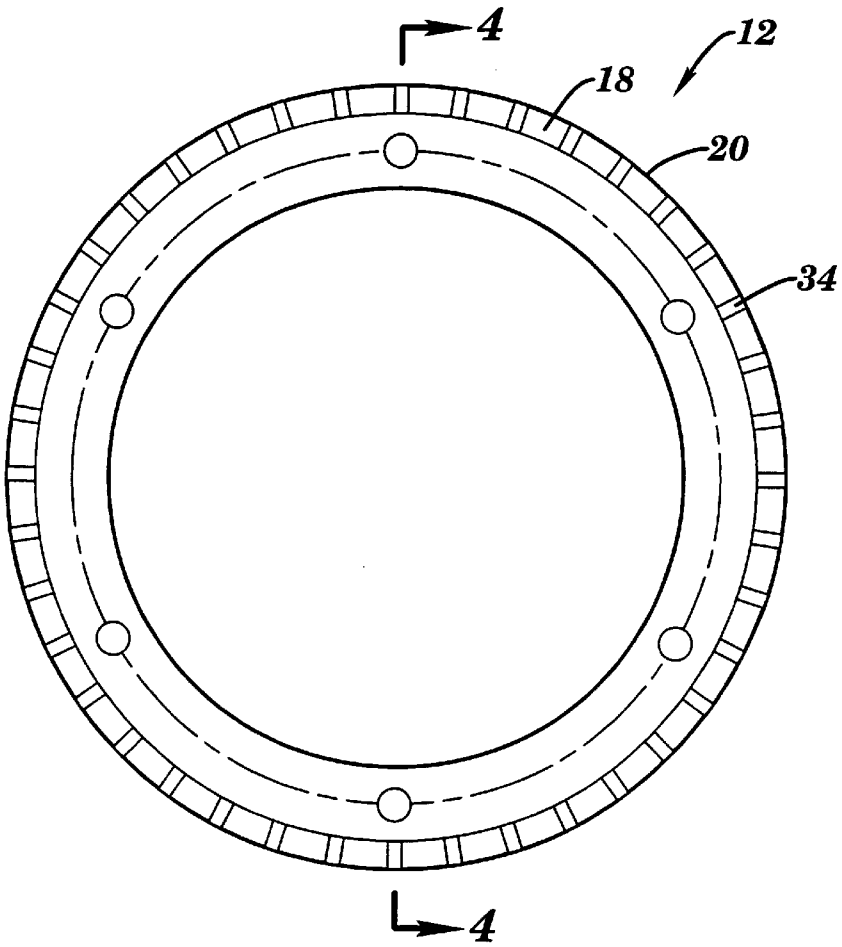
FIG. 3 is a plan view, on a reduced scale, of an annular grinding element adapted for use on the grinding wheel of FIG. 1.
Figure 4A:
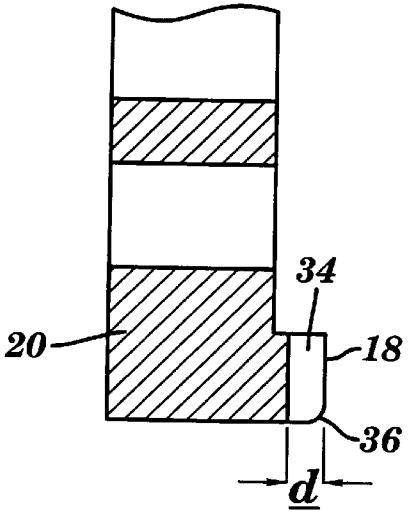
FIG. 4A is an enlarged view of a portion of FIG. 4.
Figure 4:
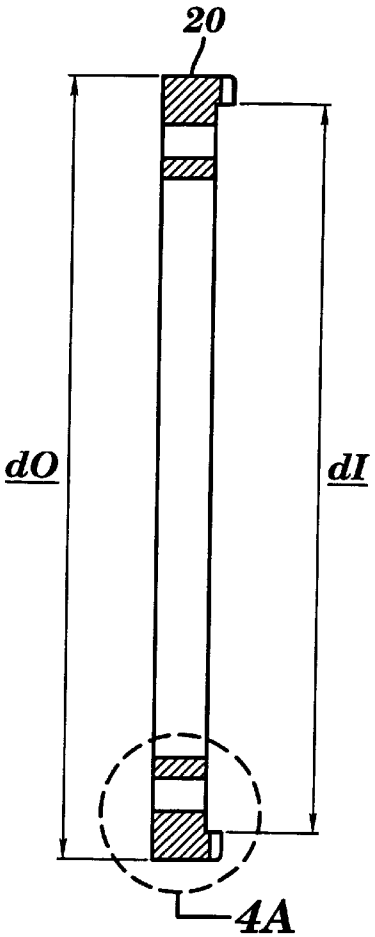
FIG. 4 is a cross-sectional view taken along 4—4 of FIG. 3.

Turning now to FIGS. 3–4A, outer element 12 preferably comprises a single layer 18 (FIG. 4A) of diamond abrasive bonded in a bronze braze on the face of metallic substrate 20. Although this bronze bond and diamond abrasive are preferred, a wide range of acceptable bond materials and abrasive grains may be utilized. In particular, substantially any single layer of abrasive, such as the single layer of brazed diamond, may be used. While electroplated single layer abrasive tools have been used, the electroplated bond is much weaker than the brazed bond, resulting in shorter tool life. In addition, abrasive grains are lost from the electroplated tool during grinding and the loose grains tend to score or scratch the work piece. In such single layer abrasive wheels, the height of the abrasive should be kept nearly uniform to minimize wheel "runout." The wheel can be finished to substantially reduce any runout by conventional grinding or machining to eliminate protruding grains and/or by using shim stock as will be discussed hereinafter. Advantageously, wheels comprising a metallic substrate 20 with a single layer of abrasive 18 generally do not require conventional truing or dressing and thus are preferred. This preferred embodiment is shown and described herein. In addition, however, open structure face grinding wheels that utilize a highly porous bond matrix, such as wheels having about 55 to 80 volume percent interconnected porosity may be used. Wheels comprising conventional vitrified bond are preferred for creating a porous matrix having sufficient strength and tool life to grind bimetallic components. Interconnected porosity, and a permeability test useful for determining the porosity as a volume percent is disclosed in U.S. patent application Ser. No. 08/687,816, which is fully incorporated by reference herein.

It was discovered that such open structure or porosity facilitates delivery of coolant to the workpiece and removal of debris or grinding swarf and helps avoid scratching the surface of the work piece. This aspect is particularly important when the workpiece is difficult to machine or gummy, such as aluminum, and enables the present invention to overcome the aforementioned problems commonly associated with grinding aluminum. Moreover, for this reason, in single layer abrasive wheels a plurality of radially extending slots 34 are preferably disposed in the grinding face of ring 12 to further facilitate swarf and coolant flow. For example, as shown in FIG. 3, slots 34 extend radially through element 12 at spaced locations thereabout, and extend to a predetermined axial depth d (FIG. 4A) from the single abrasive layer 18. In a preferred embodiment, the slots are formed in substrate 20 prior to application of the single abrasive layer. Thereafter, abrasive layer 18 may be applied to the substrate in a conventional manner. In an alternative embodiment, slots 34 may be formed by masking the substrate, as with a protective tape material, followed by application of a paste comprising the brazing components, and then removing the mask. The masked area will then be free of abrasive to effectively mimic the slots 34. As also shown in FIG. 4A, element 12 is preferably provided with a radius or chamfer 36 to help provide a smooth engagement of grinding wheel 10 with the workpiece and avoid scratching, particularly when wheel 10 is operated at an oblique angle $\alpha$ as shown.

Preferably, as shown, grinding element 12 is adapted for being fastened to backing plate 16 (FIG. 1) with bolts or screws wherein as mentioned above, shim stock may be conveniently utilized to facilitate height adjustment and/or runout correction of element 12 relative the backing plate. In this regard, such fastening and adjustment is advantageously simplified by fabricating element 12 in as few discrete parts as possible, such as in a one piece ring as shown. However, it may be preferable to fabricate ring 12 as a multi-part assembly, such as in two semicircular, 180 degree portions, four 90 degree portions, or some other configuration in order to prevent or ameliorate the accumulation of stresses and distortion due to high rotational speed testing. Moreover, element 12 may be fabricated as a segmented wheel, utilizing either a single layer of abrasive on a segmented metallic substrate, or utilizing a porous bond matrix such as vitrified bonded abrasive segments. The segments may be fastened to a backing plate 16 in any suitable manner such as brazing, welding or mechanical fastening. Spacing between each segment serves to form slots 34. It is preferred, however, to utilize relatively larger portions, such as at least 30–40 degree portions of the ring, to simplify assembly and height adjustment thereof as discussed above.

Wheels 10 fabricated according to the subject invention advantageously enable planarization of fire deck 8 in a single pass. Moreover, wheel performance in a particular application may be further enhanced by adjusting certain wheel parameters. In this regard, wheel 10 should preferably have an outer diameter dO (FIG. 1) diameter at least as large as the width w (transverse to tool path 26), (FIG. 2) of the workpiece. For example, an outer wheel diameter dO of 28–30 cm is preferred for an engine block having a width w of 25 cm. In a particularly preferred embodiment, both outer diameter dO and inner diameter dI (FIG. 1) are greater than width w to facilitate swarf and coolant flow, particularly when wheel 10 is operated with a 90 degree angle $\alpha$. This sizing also helps prevent loading problems between the wheel and workpiece. Another consideration with regard to wheel performance is abrasive grit size. Abrasive grit size utilized in layer 18 thus may be chosen by balancing surface finish with wheel life. In this regard, smaller grit sizes tend to produce fewer burrs and surface defects, but tend to promote shorter wheel life. For a single ring wheel, diamond grit sizes of about 20 to 50 are preferred. Conventional abrasive grit sizes of about 80 to 120 are preferred.

As mentioned hereinabove, inner ring 12 should have a runout of less than 50 microns over the abrasives. In a preferred embodiment utilizing a single layer 18 of abrasive, as long as substrate 20 is true, approximately 10% of the maximum abrasive diameter may be ground off using a resin bonded diamond wheel to correct any runout in the layer 18. This translates to grinding as much as approximately .003" from a layer of 20/25 mesh abrasive and .0016" from a 40/45 mesh abrasive.

Figure 5:
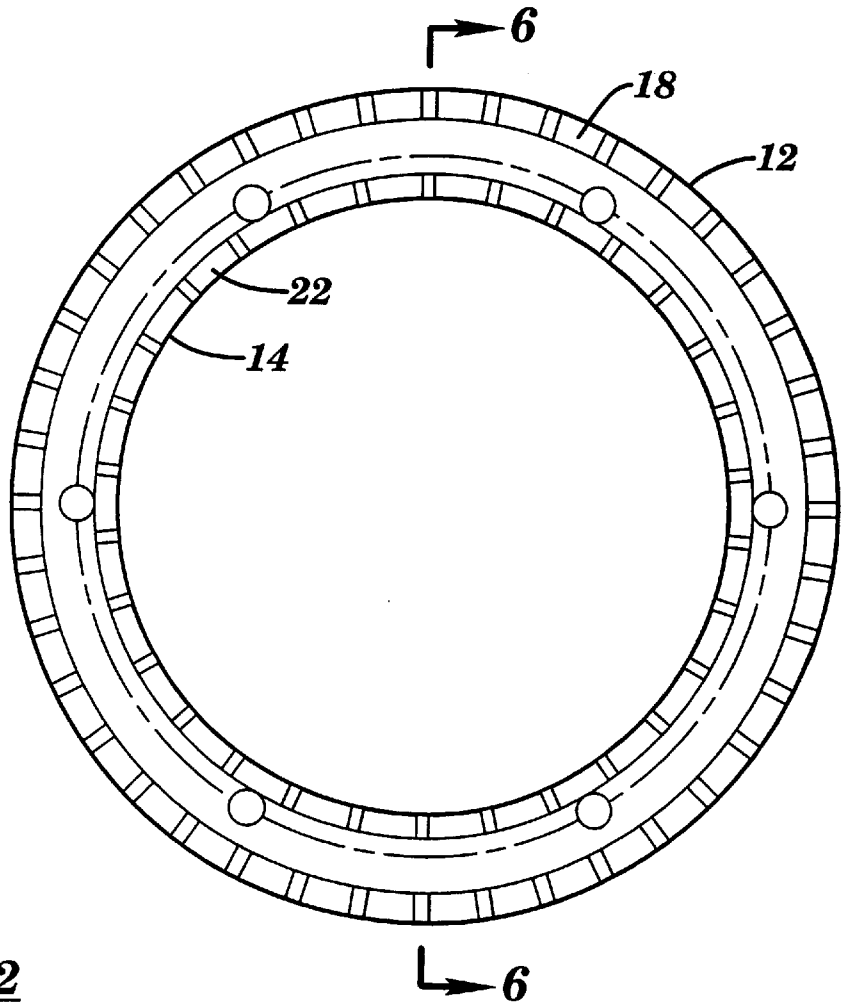
FIG. 5 is a view similar to that of FIG. 3, on a reduced scale, of a pair of concentric annular grinding elements adapted for use on the grinding wheel of FIG. 1.
Figure 6A:
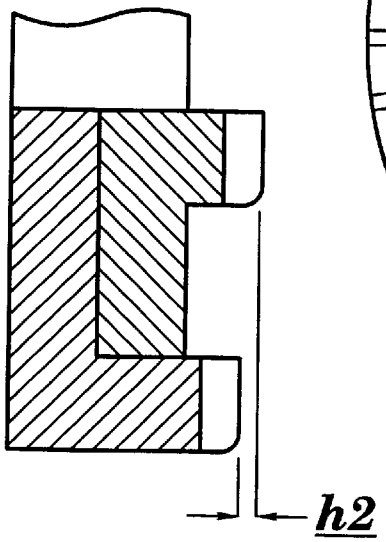
FIG. 6A is an enlarged view of a portion of FIG. 6.
Figure 6:
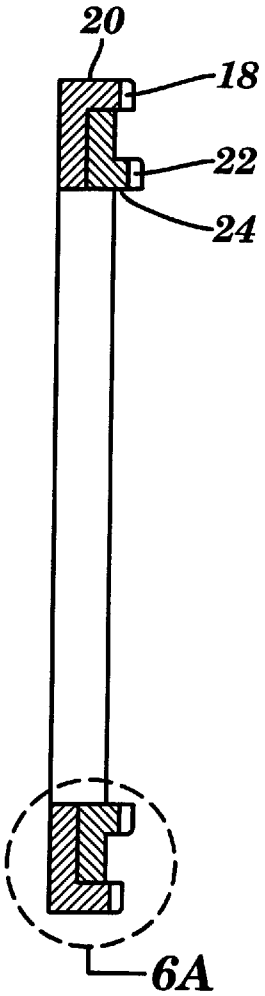
FIG. 6 is a cross-sectional view taken along 6—6 of FIG. 5.

Turning now to FIGS. 5–6A, in an alternate embodiment, an inner annular grinding element 14 is disposed concentrically inward of element 12. Element 14 is preferably fabricated in a manner similar to that of outer element 12, utilizing the same or different abrasive grain size, as will be discussed hereinafter. Elements 12 and 14 are fabricated either as continuous rings or in 2–4 pieces each. Segmented ring manufacture is not satisfactory because excessive wheel height adjustments are needed. As shown, each ring 12 and 14, including their respective substrates 20 and 24, is fabricated to be discrete from one another. In this manner, they are individually fastened to backing plate 16 (FIG. 1) to facilitate independent height adjustment of elements 12 and 14, such as with shim stock, relative backing plate 16 and relative one another to provide a predetermined height h2 therebetween. Height h2 is determined based on the grit size of abrasive used on each ring 12 and 14.

Thus, during grinding operation in the manner described hereinabove with respect to FIGS. 1 and 2, outer ring 12 will engage the block for the majority of material removal, followed by inner ring 14 which serves to remove a smaller amount of material to eliminate any burrs or other surface imperfections, etc. generated by the outer element and to apply the requisite surface finish to fire deck 8.

This double-ring embodiment enables the use of grit sizes more closely optimized for finishing bimetallic block 9. Thus, a relatively coarse grit may be utilized on outer ring 12 to efficiently remove the requisite amount of metal, and a finer grit used on inner ring 14 to provide the fire deck with the desired surface finish. This configuration may advantageously improve wheel efficiency for improved wheel life. For example, the diamond grit size used on outer ring 12 may be 20–40 mesh, or larger, while the inner grit size may be 100–120 mesh or smaller. The amount of material removed by inner wheel 14 is a function of height h2, by which the inner wheel extends closer to the workpiece than outer wheel 12 during its pass over block 9. This height may be approximately 20–40 microns.

The resulting surface finish utilizing a wheel of this embodiment is a function of the radial distance between inner ring 12 and outer ring 14, the surface area of contact between each ring and the work piece, the grit sizes of the abrasive on each ring, and height h2 between each of ring 12 and 14.

In an additional aspect of this embodiment, an single abrasive layer 18 on a metallic substrate 20 may be utilized as outer ring 12, in combination with a conventional matrix bonded abrasive grinding wheel as inner ring 14. In a variation of this aspect, the inner wheel may be replaced with a cutting tool, by brazing one or more cutting tool inserts, i.e., CBN (Cubic Boron Nitride) or PCD (polycrystalline diamond) to the wheel radially inwards of outer ring 12. The tool inserts are preferably provided with a zero to negative rake, a chamfered cutting edge, and a slight, about 5° , clearance angle at the rear of the cut. The purpose of the inserts is to remove as little material as possible but to leave a smooth surface finish.

The grinding wheels of the present invention thus have a relatively large number of cutting points provided by each abrasive grain of a grinding wheel. The wheels thus provide a relatively continuous contact with the workpiece and take smaller cuts or bites from the workpiece. This serves to smooth the transitions between the hard phase of the cast iron cylinder liners 30 and the soft phase of the aluminum block 28. Better flatness or planarity and surface finish have thus been observed with the grinding process of the present invention relative to the prior art milling processes.

The following illustrative examples are intended to demonstrate certain aspects of the present invention. All of the wheels in the Examples were type 6, cup shaped wheels of the type shown in FIG. 1, with an 8 in (20 cm) outer diameter. They were all tested by grinding a 7 inch (18 cm) aluminum/cast iron bimetallic engine block of the type described hereinabove. These tests are summarized in Table I.

TABLE 1

Maximum Material Removal Rates

| Wheel Sample Examples 1–16 | Power (at maximum MRR) | Maximum MRR (inches 3/min) | Feed Rate inches/min. | Depth of Cut per Pass |
|---|---|---|---|---|
| 1 Control | 9.28 | 0.25 | 20 | 0.005 |
| 2 Control | 7.36 | 0.25 | 20 | 0.005 |
| 3 Control | 6.88 | 2.50 | 70 | 0.014 |
| 4 Exp. | 6.56 | 3.16 | 90 | 0.014 |
| 5 Exp. | 5.92 | 3.86 | 110 | 0.014 |
| 6 Exp. | 6.4 | 2.10 | 60 | 0.014 |
| 7 Exp. | 6.8 | 1.76 | 50 | 0.014 |
| 8 Control | 1.6 | 1.00 | 20 | 0.02 |
| 9 Control | 1.76 | 1.00 | 20 | 0.02 |
| 10 Exp. | 1.44 | 1.50 | 30 | 0.02 |
| 11 Exp. | 1.921 | 2.00 | 40 | 0.02 |
| 12 Exp. | 1.120 | 2.50 | 50 | 0.02 |
| 13 Control | 5.28 | 1.00 | 20 | 0.02 |
| 14 Control | 6.24 | 1.00 | 20 | 0.02 |
| 15 Control | 11.04 | 0.75 | 15 | 0.02 |
| 16 Control | 7.2 | 0.63 | 50 | 0.005 |

Grinding Conditions

Okuma Machining Center (10 HP), with vertical spindle, CNC controlled

External coolant pump (20 psi)

Master Chemical E210 water soluble coolant at 10% in water, 30 gall/min.

Wheel speed—3,000 rpm

Work piece feed rate and depth of cut—See Table 1

All conventional abrasive wheel rims were 1 inch wide

Superabrasive wheel 7 was 0.2 inch wide; all other superabrasive wheels were 0.08 inch wide.

As shown, Examples 4–7 and 10–12 of the present invention provide substantially improved material removal rates relative to control wheels 1–3, 8, 9 and 13–16. Wheels of the invention yielded material removal rates at least comparable to the rates achieved by milling operations used in the art. The flatness and surface finish achieved with the wheels of the invention was superior to that possible in a milling operation or with electroplated wheels over tool life. Moreover, although surface flatness and finish were acceptable for all wheels tested, finish was better with wheels having wider rims (e.g., for wheel 7, with a width of about 2 times the width of wheels 4–6, there was a 100 times decrease in surface roughness units ($R_a$ $\mu$inch)). At material removal rates over about 3 $in^3$/min, surface finish began to degrade and power draw began to decrease. At rates below 3 $in^3$/min, brazed single layer diamond tools (4–7) gave the best surface results (the diamond cut freely, relative to conventional abrasives, and there was no discernible grain loss to scratch the surface). It is to be understood that these examples should not be construed as limiting.

EXAMPLES 1 AND 2

Control Wheels—Vitrified bonded diamond wheels with less than 55% porosity.

EXAMPLE 3

Control wheel—30/40 grit size diamond in electroplated metal bonded single layer diamond wheels with slots cut into the steel core of the wheel.

EXAMPLE 4

Invention wheel—20/25 grit size diamond bonded in 77/23 Cu/Sn bronze braze. The wheel was made with "slots" created by masking about 20% of the area of the abrasive rim with tape, applying a paste containing the metal powder of the braze in an organic binder to the rim, removing the tape and applying the diamond to the remaining paste, and then brazing the wheel at about 800–900° C.

EXAMPLE 5

Invention wheel—20/25 grit size diamond bonded as in Example 4 and used on steel core having slots cut into the steel rim in about 20% of the area of the rim.

EXAMPLE 6

Invention wheel—30/35 grit size diamond bonded and made as Example 4.

EXAMPLE 7

Invention Wheel—30 grit size diamond bonded as a single layer on a steel rim with a silver/copper braze at above 900° C. The steel rim was segmented and slots were created between the segments. The abrasive was applied to the individual segments and brazed, and finished segments were attached to the steel core backing.

EXAMPLE 8

Control wheel—80 grit size sol gel microcrystalline alpha-alumina filamentary grain, having a length:width aspect ratio of 4:1, made according to U.S. Pat. No. 5,244,477 to Rue, et al and sold under the Norton Targa® trademark. The wheels have a vitrified bond and a total porosity of about 57%, including 41% interconnected porosity and 16% closed cell (bubble alumina) porosity.

EXAMPLE 9

Control wheel—Same as Example 8 with 120 grit size filamentary abrasive grain.

EXAMPLES 10–12

Invention wheels—Similar to Example 8 above, but wheels contain no bubble alumina, and Targa® grain had a grit size of 80 and an aspect ratio of 7.6:1, permitting manufacture of wheels with a higher interconnected porosity of 58%, 58% and 60%, respectively, in accordance with U.S. Ser. No. 08/687,816.

EXAMPLES 13 AND 14

Controls—Commercial products (phenolic resin bonded mix of fused alumina and silicon carbide grains) conventionally used for face grinding of metals. The wheels have a porosity of about 20–40 volume %.

EXAMPLE 15

Control Wheel—37 grit size silicon carbide grain bonded in a vitrified matrix with a porosity of less than 55% (about 30–35%).

EXAMPLE 16

Control Wheel—39 grit size silicon carbide grain bonded in a vitrified matrix with a porosity of less than 55% (about 30–35%).

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A grinding cup wheel adapted for abrasively grinding a fire deck of a bimetallic engine block, said grinding cup wheel comprising:

a first annular grinding element removably disposed on said wheel in concentric orientation with an axis of rotation thereof, said first annular grinding element comprising a first abrasive component chosen from the group consisting of metal brazed single layer abrasive components and abrasive components comprising grain bonded in a porous matrix having about 55 to 80 volume percent interconnected porosity.

2. The grinding cup wheel as set forth in claim 1, wherein said first annular grinding element is a metal brazed single layer abrasive component disposed on a surface of an annular metallic substrate, the surface of said annular metallic substrate having a plurality of slots dividing the metal brazed single layer abrasive component into segments, the slots extending in a radial direction from the axis of rotation of the grinding cup wheel.

3. The grinding cup wheel of claim 2, wherein said metal brazed single layer abrasive component comprises a single layer of diamond abrasive grains brazed onto said first annular metallic substrate.

4. The grinding cup wheel of claim 3, wherein said single layer of diamond abrasive grains comprises diamond grains having a grit size within a range of approximately 20–120.

5. The grinding cup wheel of claim 3, wherein said single layer of diamond abrasive grains is brazed onto the surface of said first annular metallic substrate with a bronze braze.

6. The grinding cup wheel of claim 1, wherein said abrasive component comprises filamentary sol gel alpha alumina abrasives having an aspect ratio of at least 5:1 bonded in a porous matrix.

7. The grinding cup wheel of claim 6, wherein said porous matrix comprises a vitrified bond.

8. The grinding cup wheel of claim 1, wherein said first abrasive component extends discontinuously along said first annular grinding element.

9. The grinding cup wheel of claim 1, wherein said first annular grinding element comprises a plurality of discrete arcuate portions.

10. The grinding cup wheel of claim 9, wherein said plurality of discrete arcuate portions comprises four 90-degree arcuate portions.

11. The grinding cup wheel of claim 9, wherein each of said plurality of discrete arcuate portions includes a plurality of said first abrasive components disposed thereon.

12. A grinding cup wheel adapted for abrasively grinding a fire deck of a bimetallic engine block, said grinding cup wheel comprising:

a first annular grinding element disposed concentrically with said grinding cup wheel;

a second annular grinding element disposed concentrically with and radially inward of said first annular grinding element, each of said first and second annular grinding elements including an abrasive component chosen from the group consisting of metal brazed single layer abrasive components and abrasive components comprising grain bonded in a porous matrix having about 55 to 80 volume percent interconnected porosity;

said second annular grinding element being disposed at a predetermined height in the axial direction closer to the fire deck of the engine block than said first annular grinding element, wherein said second annular grinding element abrasively grinds material from said fire deck after said first annular grinding element.

13. The grinding cup wheel of claim 12, wherein each of said first and second annular grinding elements is individually fastenable to said grinding cup wheel to facilitate independent height adjustment of said elements in said axial direction relative one another.

14. The grinding cup wheel of claim 12, wherein said second annular grinding element contains an abrasive of a type distinct from that of said first annular grinding element.

15. The grinding cup wheel of claim 14, wherein said second annular grinding element comprises a vitrified bonded abrasive grain.

16. The grinding cup wheel of claim 15, wherein said first annular grinding element abrasive is 40 mesh or larger diamond abrasive.

17. The grinding cup wheel of claim 12, wherein said first and second annular grinding elements have a plurality of slots extending therethrough.

18. The grinding cup wheel of claim 12, wherein said first and second annular grinding elements are comprised of a plurality of discrete arcuate portions.

19. The grinding wheel of claim 12, wherein said first and second abrasive elements comprise metal brazed single layer abrasive components which comprise a single layer of diamond abrasive grains brazed onto said first and second annular metallic substrates.

20. A grinding cup wheel adapted for surface grinding a bimetallic workpiece, said grinding cup wheel comprising:

(a) a first annular grinding element disposed concentrically with an axis of rotation of said wheel;

(b) a second annular grinding element disposed concentrically with and radially inward of said first annular grinding element, each of said first and second annular grinding elements having grinding surfaces adapted to engage the workpiece, said grinding surface of said second annular grinding element being disposed at a predetermined height in the axial direction closer to the engine block than that of said first annular grinding element;

(c) said first annular grinding element and said second annular grinding element each including an abrasive component chosen from the group consisting of metal brazed single layer abrasive components and abrasive components bonded in porous matrix having about 55 to 80 volume percent interconnected porosity;

(d) said grinding cup wheel being adapted for orientation of the axis of rotation at a predetermined angle alpha relative the fire deck and for being translated towards the engine block along a tool path parallel to the fire deck;

(e) wherein said first annular grinding element is adapted to engage and abrasively grind material from the block and said second annular grinding element is adapted to abrasively grind material from the fire deck after said first annular grinding ring, so that said second annular grinding ring is adapted to apply a surface finish to the fire deck.

* * * * *